US008714821B2

(12) United States Patent
Nanba et al.

(10) Patent No.: US 8,714,821 B2
(45) Date of Patent: May 6, 2014

(54) CUTTING TAPE AND PACKAGING BAG WITH CUTTING TAPE

(75) Inventors: Yoshinori Nanba, Mie (JP); Kenichi Tanaka, Chiba (JP)

(73) Assignee: Idemitsu Unitech Co., Ltd., Tokyo (JP)

( * ) Notice: Subject to any disclaimer, the term of this patent is extended or adjusted under 35 U.S.C. 154(b) by 546 days.

(21) Appl. No.: 12/741,895

(22) PCT Filed: Nov. 7, 2008

(86) PCT No.: PCT/JP2008/070297

§ 371 (c)(1),
(2), (4) Date: May 7, 2010

(87) PCT Pub. No.: WO2009/060940

PCT Pub. Date: May 14, 2009

(65) Prior Publication Data

US 2010/0266224 A1 Oct. 21, 2010

(30) Foreign Application Priority Data

Nov. 8, 2007 (JP) ..... 2007-290886

(51) Int. Cl.
*B65D 33/00* (2006.01)
*B65D 65/26* (2006.01)

(52) U.S. Cl.
USPC ..... 383/204; 383/200; 383/205

(58) Field of Classification Search
CPC ..... B65D 75/58; B65D 75/5805; B65D 33/2533; B65D 75/66; B65D 75/68
USPC ..... 383/204, 205, 200
See application file for complete search history.

(56) References Cited

U.S. PATENT DOCUMENTS

| | | | | | |
|---|---|---|---|---|---|
| 2,075,136 | A | | 3/1937 | MacGiffert et al. | |
| 2,952,395 | A | * | 9/1960 | Spees | 383/205 |
| 2,991,000 | A | * | 7/1961 | Spees | 383/205 |
| 3,625,270 | A | * | 12/1971 | Skendzic | 383/204 |
| 4,378,074 | A | * | 3/1983 | Brochman | 220/260 |
| 4,500,011 | A | * | 2/1985 | Brochman | 220/359.3 |

(Continued)

FOREIGN PATENT DOCUMENTS

| | | |
|---|---|---|
| EP | 1 607 340 | 12/2005 |
| JP | 1-128545 U | 9/1989 |

(Continued)

OTHER PUBLICATIONS

Supplementary European Search Report for EP08 84 6501 dated Feb. 13, 2012.

(Continued)

*Primary Examiner* — Anthony Stashick
*Assistant Examiner* — Latrice Byrd
(74) *Attorney, Agent, or Firm* — Millen, White, Zelano & Branigan, P.C.

(57) ABSTRACT

A cutting tape includes a leading portion, a first base, a second base and a seal layer. The leading portion is welded on a sealant layer with the seal layer interposed therebetween. The first base and the second base, which are laminated on the leading portion, respectively include thin laminated portions and body portions to be welded on the sealant layer. The laminated portions are welded on the leading portion. The body portions respectively have a substantially trapezoidal cross section projecting toward the sealant layer and having an inclined surface adjacent to the leading portion.

7 Claims, 8 Drawing Sheets

(56) References Cited

U.S. PATENT DOCUMENTS

| | | | | | |
|---|---|---|---|---|---|
| 4,553,693 | A | * | 11/1985 | Terajima et al. | 229/75 |
| 4,595,116 | A | * | 6/1986 | Carlsson | 220/359.3 |
| 4,705,197 | A | * | 11/1987 | Gordon et al. | 229/123.3 |
| 4,756,629 | A | * | 7/1988 | Tilman et al. | 383/63 |
| 4,792,069 | A | * | 12/1988 | Nantin et al. | 222/527 |
| 5,263,777 | A | * | 11/1993 | Domke | 383/103 |
| 5,310,262 | A | * | 5/1994 | Robison et al. | 383/205 |
| 5,375,930 | A | | 12/1994 | Tani | |
| 5,486,051 | A | * | 1/1996 | May | 383/200 |
| 5,542,902 | A | * | 8/1996 | Richison et al. | 493/195 |
| 5,660,479 | A | * | 8/1997 | May et al. | 383/204 |
| 5,833,368 | A | * | 11/1998 | Kaufman | 383/205 |
| 5,855,435 | A | * | 1/1999 | Chiesa | 383/204 |
| 5,887,980 | A | * | 3/1999 | May | 383/204 |
| 5,897,052 | A | * | 4/1999 | Tanaka et al. | 229/205 |
| 6,106,153 | A | * | 8/2000 | Toshima | 383/204 |
| 6,779,921 | B2 | * | 8/2004 | Yeager | 383/42 |
| 6,955,466 | B1 | * | 10/2005 | Soderholm | 383/205 |
| 7,032,810 | B2 | * | 4/2006 | Benedetti et al. | 229/238 |
| 7,314,312 | B2 | * | 1/2008 | Soderholm | 383/205 |
| 8,066,434 | B2 | * | 11/2011 | Nanba et al. | 383/204 |
| 2005/0063624 | A1 | * | 3/2005 | Goto et al. | 383/205 |
| 2009/0022435 | A1 | * | 1/2009 | Tanaka et al. | 383/210.1 |

FOREIGN PATENT DOCUMENTS

| | | | |
|---|---|---|---|
| JP | 6-286758 | A | 10/1994 |
| JP | 10-59384 | A | 3/1998 |
| JP | 2004-155446 | A | 6/2004 |

OTHER PUBLICATIONS

International Search Report of PCT/JP2008/070297 (Feb. 2, 2009).

* cited by examiner

CUTTING TAPE AND PACKAGING BAG WITH CUTTING TAPE

TECHNICAL FIELD

The present invention relates to a cutting tape attached to an inner surface of a packaging bag and a packaging bag provided with the cutting tape.

BACKGROUND ART

A typical packaging bag for packaging various articles such as foods, pharmaceutical and medical products and groceries is sealed at an upper side thereof. When the packaging bag is opened, films forming a bag body are torn apart from notches and the like (as a starting point) provided on both sides of the packaging bag.

However, it is difficult to linearly cut the films forming the bag body. Accordingly, a structure to be opened at a predetermined position has been desired.

There has been proposed a packaging bag provided with a reinforcement string as a guide and a guiding tape, in which the guiding tape is guided by the reinforcement string to be linearly torn away, whereby the packaging bag is opened (for instance, Patent Document 1).

Alternatively, there has been proposed a technique to open a packaging bag by linearly tearing away a film using a cutting string (for instance, Patent Document 2).

[Patent Document] 1 JP-A-10-59384

[Patent Document] 2 JP-A-6-286758

DISCLOSURE OF THE INVENTION

Problems to Be Solved by the Invention

In Patent Document 1, however, bag-producing procedure, which requires separate attachment of the reinforcement string and the guiding tape, was complicated and difficult. Moreover, since only a specific machine can produce such a bag, the bag is not easily available as a product.

A bag of Patent Document 2 is similarly difficult to serve as a product due to difficult processing by typical bag-making machines and lacking versatility.

Further, even when the bag can be linearly torn away, two films of the bag body at a cut edge of the torn packaging bag becomes aligned with each other. Consequently, a finger may not be easily put into between the films, so that it is difficult to pinch an opening of the packaging bag.

An object of the invention is to provide a cutting tape and a packaging bag provided with the cutting tape, the cutting tape being capable of being torn away freely and linearly to easily open the packaging bag and capable of being easily attached to the packaging bag by typical bag-making machines.

Means for Solving the Problems

A cutting tape according to an aspect of the invention, provided on an inner surface of a bag body of a packaging bag, includes: a leading portion that is welded in a belt shape on the inner surface for the bag body; and a base having a laminated portion, which is laminated on a surface of the leading portion opposite to a surface thereof adjacent to the inner surface of the bag body and includes an exposed portion that is an exposed part of the leading portion, and a body portion, which is integrated with the laminated portion and is welded on the inner surface of the bag body, in which the leading portion and the base are formed of mutually non-compatible resins.

The cutting tape according to the aspect of the invention is formed with a leading portion in a belt-shape and a base laminated on the leading portion. When a film of the packaging bag provided with the cutting tape is torn away to be opened, the leading portion serves as a leading member to a tearing position of the film. The base, which is a member laminated on a surface opposite to a surface on which the leading portion is welded to the bag body, includes the laminated portion bonded to the leading portion and the body portion continuous with the laminated portion.

The laminated portion has the exposed portion where the leading portion is exposed in a belt shape. The exposed portion is, for instance, an elongated aperture formed in a longitudinal direction of the laminated portion, through which the lading portion is exposed. The exposed portion is preferably formed in a belt-shape along the leading portion since the exposed portion is to serve as an opening when the packaging bag is opened.

A surface of the body portion adjacent to the leading portion is welded on the inner surface of the bag body.

The leading portion and the base are formed of mutually non-compatible resins. When the resins have a good compatibility, the resins are blended to each other to extremely increase bonding strength, which is unfavorable. Even when the resins are non-compatible, the resins are required to have a bonding strength such that the resins can be bonded to each other.

For instance, non-compatible resins are co-extruded, cut into a 15-mm piece, and pulled by a digital force gauge (manufactured by IMADA Co., Ltd.; product name "High Performance Digital Force Gauge ZP series"). A value (bonding strength) pulled at a speed of 300 mm/min in a vertical direction is preferably 20N/15 mm or less. More preferably, the value is in a range of 1N/15 mm and 8N/15 mm. When the bonding strength is more than 20N/15 mm, it is difficult or impossible to open the bag due to an excessively strong bonding strength, which is unfavorable.

With this arrangement of the cutting tape, a first surface of the leading portion and the body portion of the base are sealed on the inner surface of the bag body; and a second surface of the leading portion and the laminated portion of the base are sealed to each other. The packaging bag can be opened by peeling the leading portion and the laminated portion (the base) from each other. The exposed portion formed on the laminated portion is covered with the leading portion before opening. In opening, the exposed portion is to be the opening of the packaging bag since the leading portion is peeled off from the laminated portion (the base).

With this arrangement, the opening is surrounded by the base. Accordingly, when opening the opening with fingers, the fingers can be easily hooked on the surrounding base, thereby easily and widely opening the opening, and consequently exhibiting an excellent easy-open performance.

Moreover, since non-compatible resins are used for the leading portion and the base to be peeled off from each other in opening, a bonding strength between the leading portion and the base is weak. Consequently, when opening the packaging bag by pinching the leading portion and the film of the bag body, the bag can be opened without tearing resistance since the leading portion and the base are easily peeled off from each other.

Moreover, since the film of the bag body is torn away as being guided by the leading portion, the films of the bag can linearly be torn away, which exhibits excellent tearing performance.

Further, owing to such a quite simple arrangement of the cutting tape provided with the leading portion and the base, the cutting tape can be easily produced by co-extrusion and the like.

In order to attach the cutting tape on the bag body, a single belt-shaped cutting tape is interposed between two films forming the bag to be sealed to one another. Accordingly, the cutting tape can be easily attached to the bag by typical bag-making machines.

In the cutting tape according to the aspect of the invention, preferably, the base includes a first base and a second base with the leading portion interposed therebetween, in which each of the first base and the second base includes the laminated portion and the body portion; the laminated portion of the first base and the laminated portion of the second base are opposed to each other; and the exposed portion is formed between the laminated portion of the first base and laminated portion of the second base.

According to the aspect of the invention, the base includes a first base and a second base, each of which includes a laminated portion and a body portion. The laminated portions of the first and second bases, while facing each other, are respectively laminated on a surface opposite to a surface of the leading portion welded on the inner surface of the bag body.

With this arrangement, the exposed portion is formed between the laminated portions of the first and second bases and is covered with the leading portion. When the packaging, bag provided with the cutting tape is opened, the leading portion is peeled off from the first and second bases, so that the exposed portion serves as the opening.

Since the exposed portion is thus formed between the first and second bases, time and cost for forming the exposed portion can be avoided. Since the exposed portion can be reliably formed, the opening is reliably exposed when being opened, resulting in excellent easy-open performance.

Further, owing to such a quite simple arrangement of the cutting tape provided with the first base, the second base and the leading portion, the cutting tape can be easily produced by co-extrusion and the like.

In the cutting tape according to the aspect of the invention, the body portion preferably includes a protrusion having a substantially rectangular cross section that projects toward the inner surface of the bag body.

According to the aspect of the invention, a thickness of the protrusion is adjusted to have a thickness such that a surface of the protrusion which is welded on the bag body is in plane with a surface of the leading portion which is welded on the bag body. With this arrangement, when the cutting tape is attached to the bag body, sealing of the leading portion and the base film, sealing of the leading portion and the laminated portion, and sealing of the protrusions and the base film are simultaneously carried out in a single sealing step. Additionally, since these surfaces are in plane with each other, such these surfaces can be accurately and favorably sealed.

The protrusion preferably has a substantially trapezoidal cross section. Particularly, a distance between the welded surface of the leading portion and the welded surface of the convex can be sufficiently maintained by providing an inclined surface of the protrusion adjacent to the leading portion, so that the leading portion and the protrusion are not integrated with each other when the cutting tape is attached to the bag body, Consequently, a high quality product can be provided.

In the cutting tape according to the aspect of the invention, a width of the exposed portion in a direction perpendicular to a longitudinal direction of the leading portion is from 0.1 mm to less than a width of the leading portion.

According to the aspect of the invention, when the width of the exposed portion in the direction perpendicular to the longitudinal direction of the leading portion is less than 0.1 mm, a formed opening is difficult to be opened with fingers. When the width of the exposed portion is more than the width of the leading portion, the leading portion and the laminated portion cannot be bonded to each other, which is unfavorable.

Consequently, such a cutting tape having an excellent easy-open performance can be provided by forming an exposed portion on a surface of the leading portion.

In the cutting tape according to the aspect of the invention, a distance between the leading portion and the protrusion is from 0.1 mm to less than the width of the leading portion.

According to the aspect of the invention, when the distance between the leading portion and the protrusion provided on the base is less than 0.1 mm, the leading portion and the protrusion may be integrated with each other when sealing the cutting tape on the inner surface of the bag body, which is unfavorable. When the distance between the leading portion and the protrusion is more than the width of the leading portion, an overall width of the cutting tape is increased, which is inefficient for sealing and as a product.

Thus, easy-tearing performance and high efficiency can be achieved by providing a gap of 0.1 mm or more to less than the width of the leading portion between the leading portion and the protrusion.

In the cutting tape according to the aspect of the invention, a seal layer is laminated on a surface of the lading portion adjacent to the inner surface of the bag body.

According to the aspect of the invention, the seal layer, which is provided on the leading portion adjacent to the inner surface of the bag body, can strengthen the bonding strength between the leading portion and the inner surface of the bag body. Accordingly, the leading portion and the inner surface of the bag body are never erroneously peeled off from each other when the bag is opened. Hence, an opened packaging bag is still in a good condition.

A packaging bag according to another aspect of the invention is attached with the cutting tape according to the above aspect of the invention.

Since the packaging bag of the another aspect of the invention is provided with the cutting tape according to the above aspect of the invention, such a packaging bag provided with a cutting tape producing the same advantages as the above can be provided.

The packaging bag provided with the cutting tape according to the another aspect of the invention is preferably attached with a fastener tape on the inner surface of the bag body adjacent to a content relative to the cutting tape.

According to the above aspect of the invention, the cutting tape can be attached to the packaging bag provided with the fastener tape. Consequently, such a packaging bag provided with a cutting tape producing re-closable function of a fastener tape and the same advantages as the above can be provided.

BEST MODE FOR CARRYING OUT THE INVENTION

An embodiment of the present invention will be described below with reference to the attached drawings.

Arrangement of Packaging Bag with Cutting Tape

Figure 1:
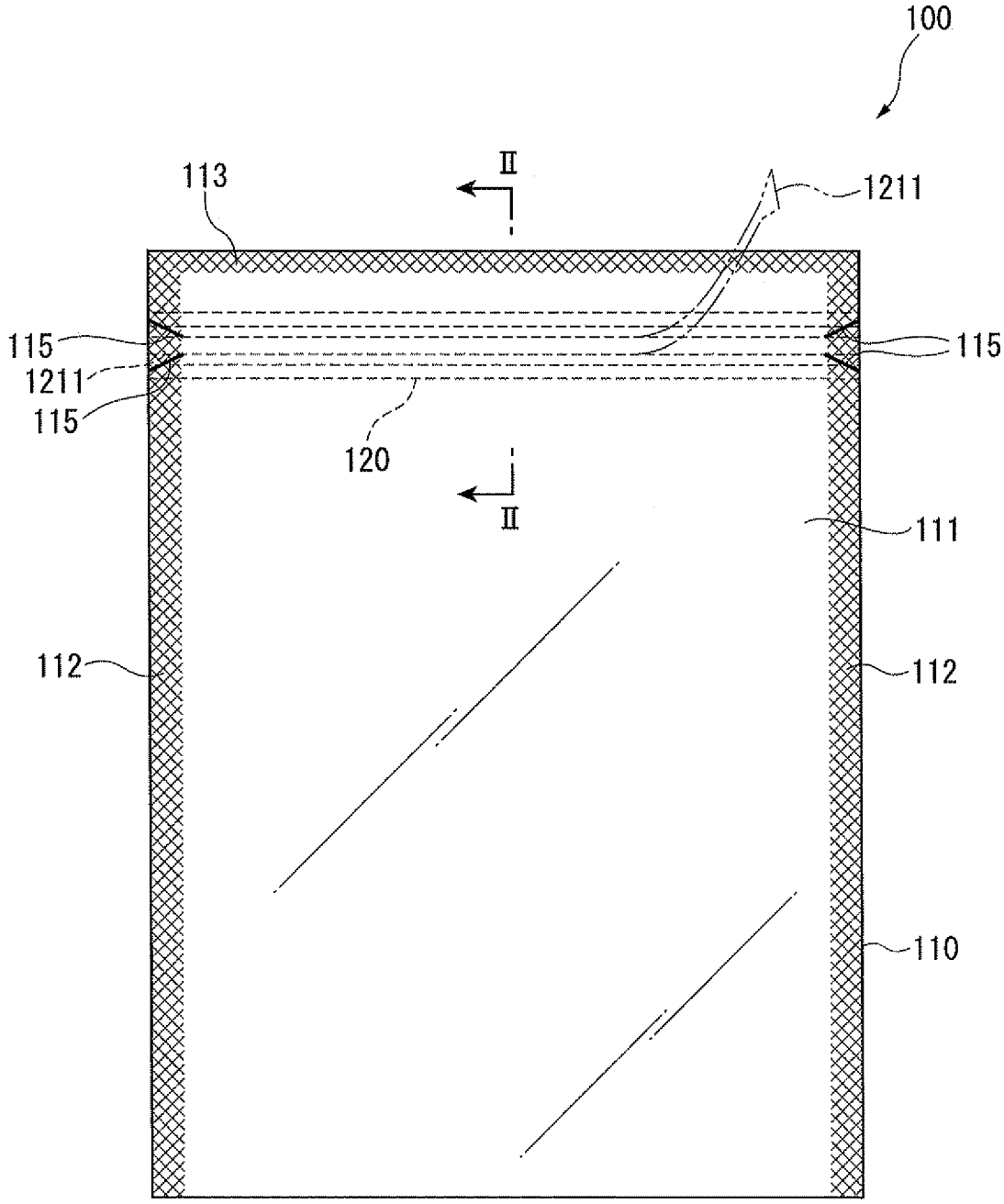
FIG. 1 is a front view of a packaging bag provided with a cutting tape according to an exemplary embodiment of the invention.
Figure 2:
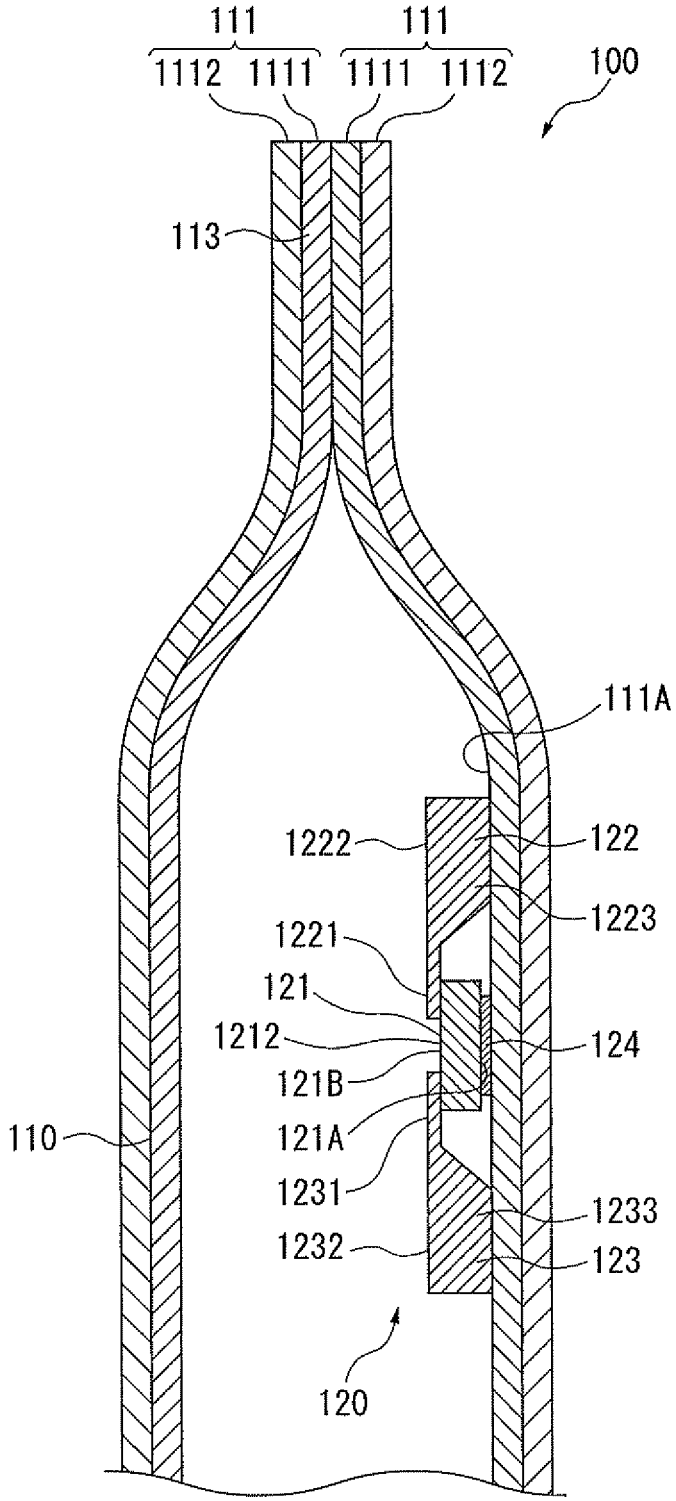
FIG. 2 shows a cross section taken along II-II segment in FIG. 1.

FIG. 1 is a front view showing a packaging bag with a cutting tape according to an exemplary embodiment of the invention. FIG. 2 shows a cross section taken along II-II segment in FIG. 1.

As shown in FIG. 1, the packaging bag 100 provided with the cutting tape according to the exemplary embodiment includes a bag body 110 provided by overlaying base films 111 with each other and forming side seal portions 112 and a top seal portion 113 on the periphery thereof. A cutting tape 120 is attached to one of inner surfaces of the bag body 110. Cut portions 115 are formed at both ends of the cutting tape 120 of the base film 111, so that ends 1211 of a leading portion 121 of the cutting tape 120 can be held.

As shown in FIG. 2, the base film 111 includes: a sealant layer 1111 forming an inner surface of the bag body 110; and a base layer 1112 forming an outer surface of the bag body 110.

The base film 111 which is a packaging material for forming the bag body 110 is preferably a laminated film formed by laminating the sealant layer 1111 on the base layer 1112. However, depending on performances required, a film such as a gas barrier layer, a light blocking layer, a strength improving layer, or the like (not shown) may be interposed between the base layer 1112 and the sealant layer 1111 as an intermediate layer.

Examples of the material for the base layer 1112 are preferably a biaxially-oriented polypropylene (OPP) film, a biaxially-oriented polyester film such as a biaxially-oriented polyethylene terephthalate (OPET) film and a biaxially-oriented polyethylene naphthalate (OPEN) film and a biaxially-oriented polyamide film such as nylon 6, nylon 66 and poly meta xylylene adipamide (MXD6). Depending on needs, various engineering plastic films are also usable. These films may be singularly used or a combination of a plurality of the films may be laminated in use.

When the intermediate layer is a gas-barrier layer, the intermediate layer may be provided by a film of ethylene-vinyl acetate copolymer saponificate (EVOH), polyvinylidene chloride (PVDC), polyacrylonitrile (PAN); aluminum foil; a vapor-deposition layer of silica, alumina, aluminum and the like; or a coating layer of PVDC.

When the vapor-deposition layer of silica, alumina or aluminum or the coating layer of PVDC is used, such a layer may be deposited or applied on an inner surface of the base layer 1112. Alternatively, such a layer may be preliminarily deposited or applied on another biaxially-oriented nylon (ONy) film, biaxially-oriented polyethylene terephthalate (PET) film or biaxially-oriented polypropylene (OPP) film, and the film may be laminated on the intermediate layer.

In the above, since aluminum foil and aluminum vapor-deposited layer are opaque, aluminum foil and aluminum vapor-deposited layer can also work as a light-shielding layer.

When the base layer 1112 and the film of the intermediate layer are laminated, known dry lamination method or extrusion lamination method (sandwich lamination method) may be employed.

Low-density polyethylene, linear low-density polyethylene, polypropylene (CPP) and the like can be used as the innermost sealant layer 1111.

In order to laminate the sealant layer 1111, the above resins may be formed as a film, which is to be laminated by a dry lamination or an extrusion lamination. Alternatively, the above resins may be laminated by extrusion coating to obtain the base film 111.

As shown in FIG. 2, the cutting tape 120 includes the leading portion 121, a first base 122, a second base 123 and a seal layer 124.

The leading portion 121 formed in an elongated shape is welded on the sealant layer 1111 with the seal layer 124 interposed therebetween. The leading portion 121 has a welded surface 121A to be welded on the sealant layer 1111 and an opposite surface 121B opposite to the welded surface 121A.

The first base 122, which is laminated on the opposite surface 121B of the leading portion 121, includes a thin laminated portion 1221 and a body portion 1222 to be welded on the sealant layer 1111. The laminated portion 1221 is welded on the opposite surface 121B. The body portion 1222 is provided with a protrusion 1223 having a substantially trapezoidal cross section, the protrusion 1223 projecting toward the sealant layer 1111 and having an inclined surface adjacent to the leading portion 121.

The second base 123, which has substantially the same shape as the first base 122, includes a laminated portion 1231 to be laminated on the opposite surface 121B of the leading portion 121 and a body portion 1232 to be welded on the sealant layer 1111. The laminated portion 1231 is welded on the opposite surface 121B. A body portion 1232 is provided with a protrusion 1233 having a substantially trapezoidal cross section, the protrusion 1233 projecting toward the sealant layer 1111 and having an inclined surface adjacent to the leading portion 121.

A thickness of the laminated portions 1221 and 1231 is not particularly limited, but is, for instance, in a range of 50 μm to 300 μm in view of sealing performance when the cutting tape 120 is welded on the bag body 110.

The first base 122 and the second base 123 are positioned such that their respective laminated portions 1221 and 1231 are opposed to each other on the opposite surface 121B of the leading portion 121. With this arrangement, an exposed portion 1212, which is an exposed part of the leading portion 121, is formed between the laminated portions 1221 and 1231.

Figure 3:
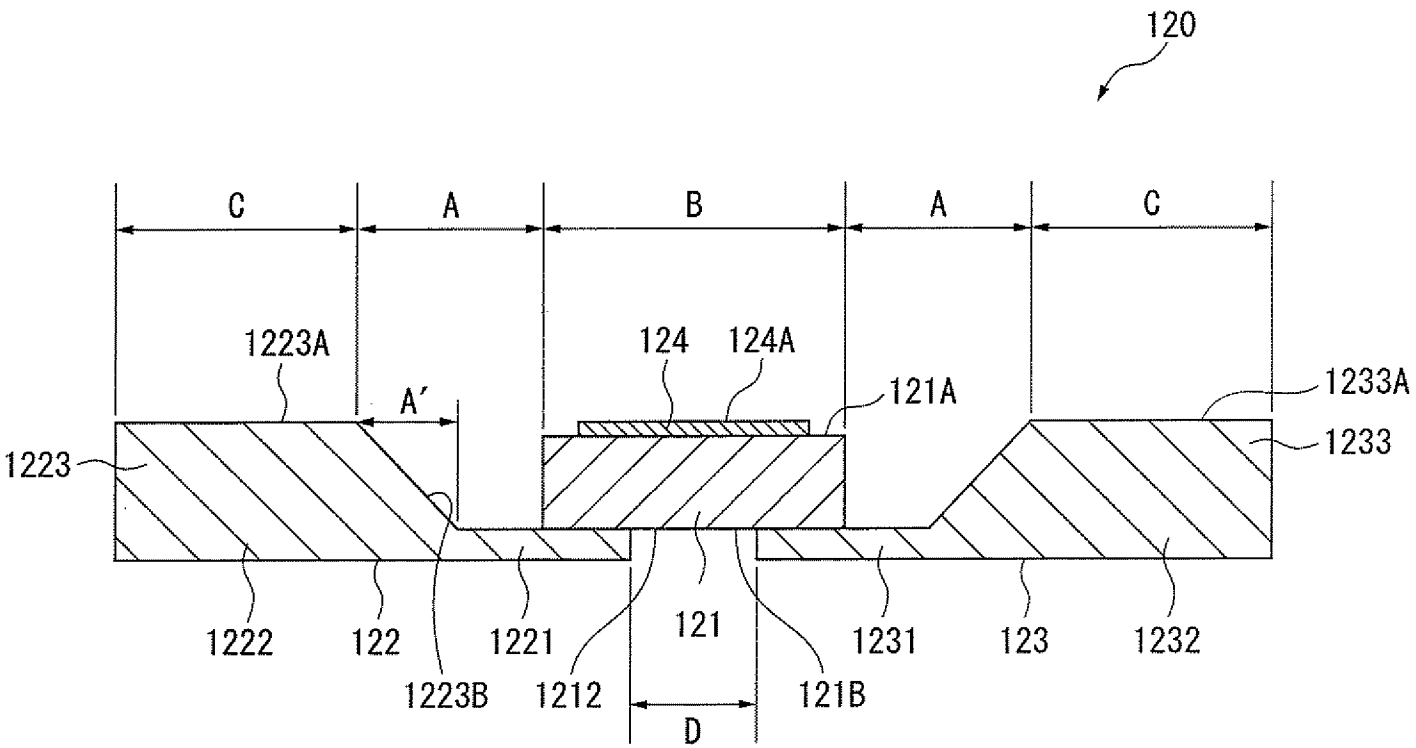
FIG. 3 shows an enlarged cross section of the cutting tape according to the exemplary embodiment of the invention.

FIG. 3 shows an enlarged cross section of the cutting tape 120. A distance from the welded surface 121A of the leading portion 121 to the protrusion 1223 is defined as A. A width of the leading portion 121 is defined as B. A width of a base welded surface 1223A of the protrusion 1223 which is welded on the sealant layer 1111 is defined as C. A distance from the first base 122 to the second base 123 is defined as D.

The distance A should be set such that the leading portion 121 and the protrusion 1223 do not contact with each other, which is, for instance, from 0.1 mm to less than the width of the leading portion 121. When the distance A is less than 0.1 mm, the protrusion 1223 and the leading portion 121 may be integrated when the cutting tape 120 is sealed to the bag body 110. The protrusion 1223 is formed in a substantially trapezoidal cross-sectional shape in this exemplary embodiment of the invention. Accordingly, the distance A can be kept equal to or more than the distance A' that is provided by the inclined surface 1223B of the protrusion 1223, even when a sealing position is slightly displaced.

The size of each of B and C is not particularly limited, which may be adjusted depending on designs and usage of the packaging bag.

The distance D is a width of the exposed portion 1212 and is 0.1 mm or more and less than the width of the leading portion 121. The distance D is preferably defined such that the laminated portion 1221 of the first base 122 and the laminated portion 1231 of the second base 123 can be attached to the opposite surface 121B of the leading portion 121.

A thickness of each of the protrusions 1223 and 1233 is adjusted to be a thickness such that the base welded surfaces 1223A and 1233A of the protrusions 1223 and 1233 are in plane with a surface 124A of the seal layer 124 which is welded on the sealant layer 1111, the seal layer 124 being laminated on the leading portion 121. For instance, the thickness of each of the protrusions 1223 and 1233 is from 200 μm to 500 μm.

When the seal layer 124 is not laminated on the leading portion 121, each of the protrusions 1223 and 1233 is designed to have a thickness such that the base welded surfaces 1223A and 1233A of the protrusions 1223 and 1233 are in plane with the welded surface 121A of the leading portion 121.

As materials for forming the leading portion 121 and the first and second bases 122 and 123, mutually non-compatible resins are selected. The non-compatible resins are preferably a combination of low-density polyethylenes and random polypropylenes.

Specifically, examples of the combination of the non-compatible resins include low-density polyethylene (LDPE)/random polypropylene (RPP), linear low-density polyethylene (LLDPE)/RPP (also partially including m-LL), LDPE/homopolypropylene (HPP), LLDPE/HPP (also partially including m-LL), LDPE/polystyrene (PS), LLDPE/PS (also partially including m-LL), RPP/PS, HPP/PS, LDPE/polyethylene terephthalate (PET), LLDPE/PET, RPP/PET, HPP/PET, PS/PET, LDPE/nylon (Ny), LLDPE/Ny, RPP/Ny, HPP/Ny and PS/Ny. These resins may be used for either one of the leading portion 121 or the first and second bases 122 and 123, but a resin of the leading portion 121 is selected so as to be highly compatible with resins of the sealant layer 1111 and the seal layer 124.

The seal layer 124 is laminated on the welded surface 121A of the leading portion 121 in order to weld the cutting tape 120 on the bag body 110. A resin highly compatible with the leading portion 121 and the sealant layer 1111 is selected as a material used for the seal layer 124. For instance, linear low-density polyethylene is usable.

As described above, the resins used for the first and second bases 122 and 123, the leading portion 121, the seal layer 124 and the sealant layer 1111 can be selected as needed in use from the above materials. For instance, the resins may be a combination among low-density polyethylene, random polypropylene, linear low-density polyethylene, and linear low-density polyethylene.

Manufacturing Method of Packaging Bag 100 with Cutting Tape

Firstly, a cutting tape 120 of the above arrangement is to be manufactured. The leading portion 121, the first base 122 and the second base 123 are integrally formed by co-extrusion, whereby the cutting tape 120 is obtained.

The above-described base film 111 and the cutting tape 120 are used for manufacturing the packaging bag 100 provided with the cutting tape by using a generally-used three-side seal bag-making machine and the like.

In the three-side seal bag-making machine, the cutting tape 120 fed from a tape feeder is positioned between a pair of the base films 111 fed from a packaging-material feeder and then the cutting tape 120 and the base film 111 are welded on each other. At this time, in the cutting tape 120, the base welded surface 1223A of the first base 122, the base welded surface 1233A of the second base 123, and the welded surface 121A of the leading portion 121 are simultaneously welded on the base film 111. Subsequently, the prepared base films 111 are delivered, welded on each other and melt-cut at a predetermined interval in a delivering direction to form a packaging bag provided with the cutting tape 100.

Opening Method of Packaging Bag 100 with Cutting Tape

Figure 4:
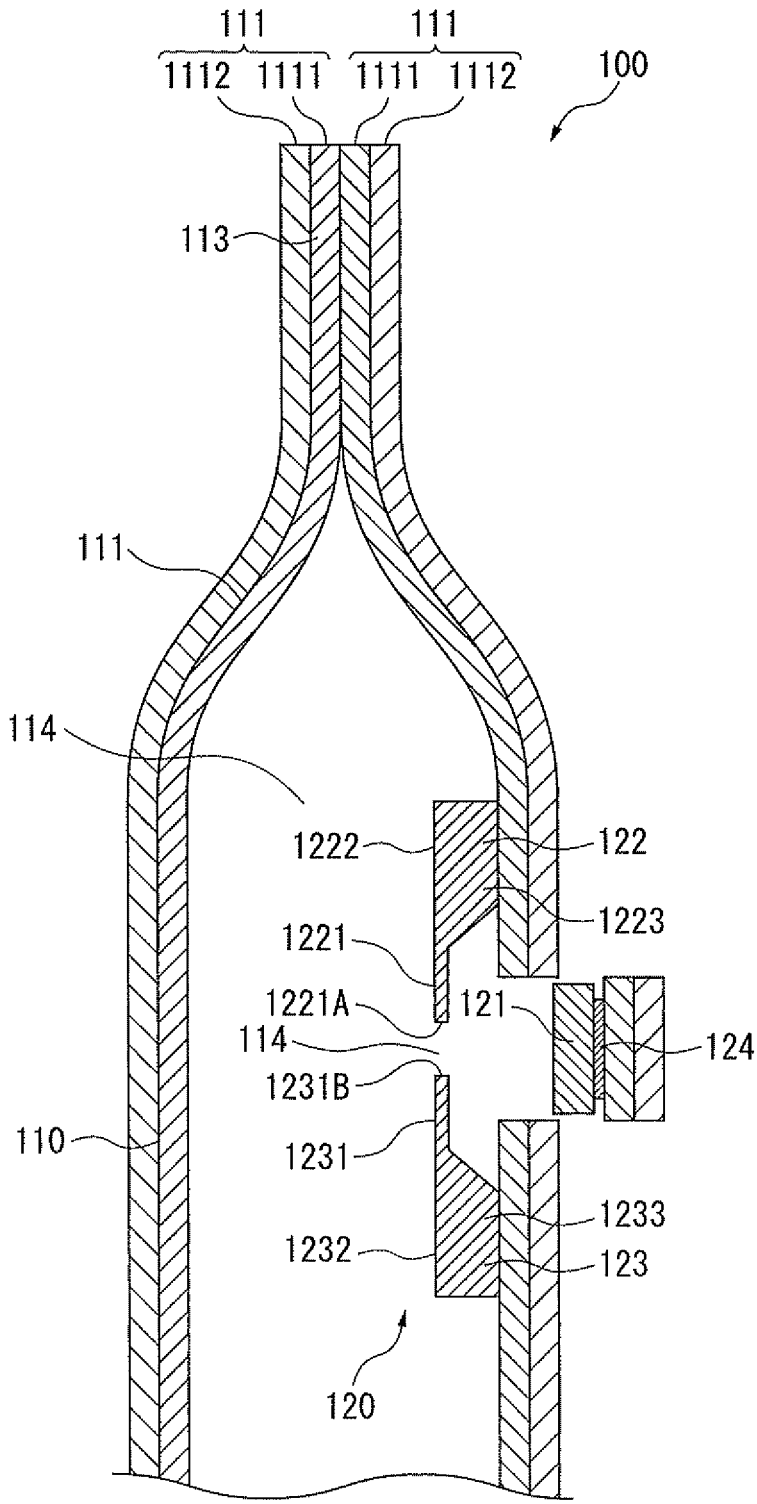
FIG. 4 shows a cross section of the packaging bag according to the exemplary embodiment of the invention in which the cutting tape has been torn away.

Next, a process for opening the packaging bag 100 provided with the cutting tape according to this exemplary embodiment will be described below with reference to FIGS. 1, 4 and 5.

As shown in FIG. 1, two cut portions 115 interposing the leading portion 121 are respectively provided on the base film 111 on both ends 1211 of the leading portion 121 of the cutting tape 120.

When opening the bag, the ends 1211 of the leading portion 121 that is arranged to be pinched by the cut portions 115, and the base film 111 overlaid on the leading portion 121 are simultaneously pinched, and the leading portion 121 and the base film 111 are pulled in a direction away from the bag body 110, so that the base film 111 of the bag body 110 is cut to open the bag. As shown in FIG. 4, when opening the bag, the leading portion 121 is peeled off from the laminated portion 1221 of the first base 122 and the laminated portion 1231 of the second base 123, so that the base film 111 is cut together with the leading portion 121. The exposed portion 1212 formed between an end surface 1221A of the laminated portion 1221 of the first base 122 and an end surface 1231A of the laminated portion 1231 of the second base 123 is defined as an opening 114. Thus, the packaging bag provided with the cutting tape 100 is openable.

Figure 5:
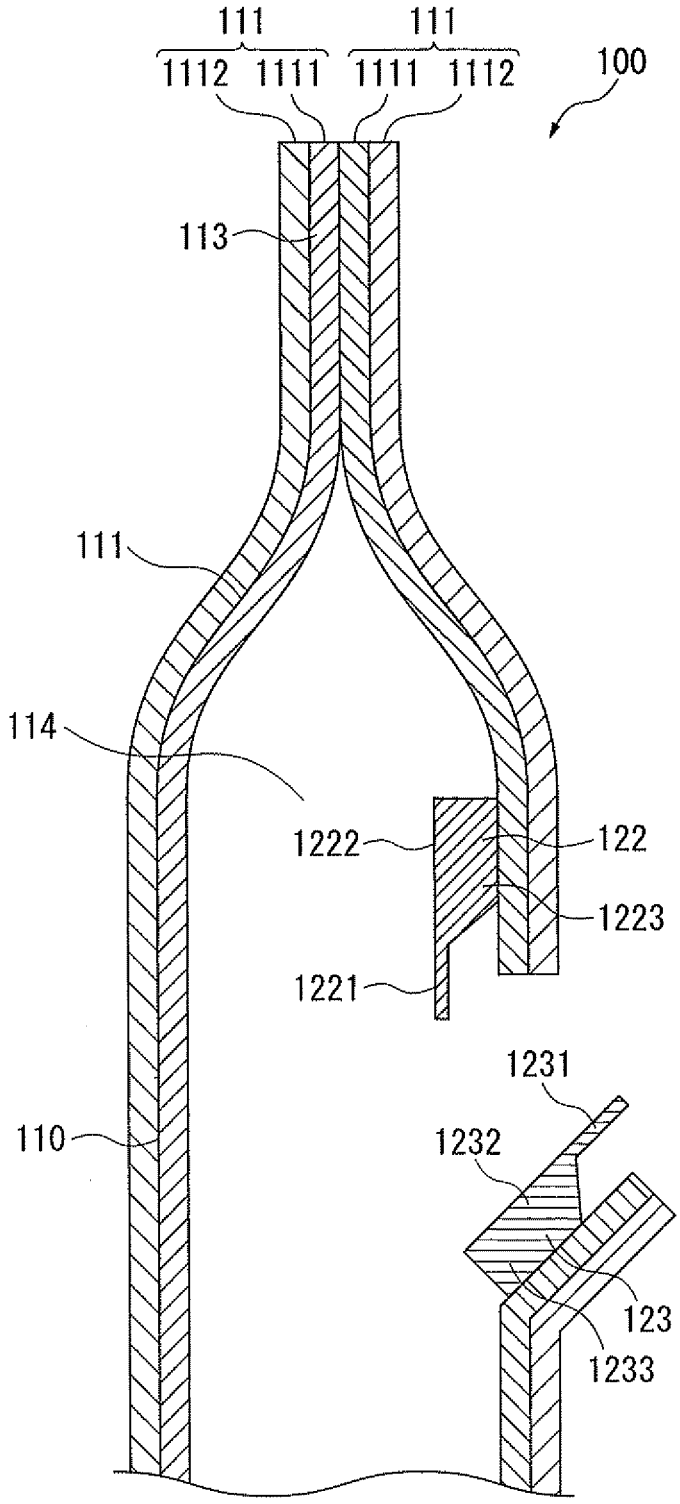
FIG. 5 shows a cross section of the packaging bag provided with the cutting tape according to the exemplary embodiment of the invention which is to be opened.

Next, as shown in FIG. 5, the opening 114 can easily and widely be opened by a finger hooked on the second base 123 on the periphery of the formed opening 114.

The above exemplary embodiment has the following advantages.

(1) Since non-compatible resins are used for the leading portion 121 and the first and second bases 122 and 123, the leading portion 121 can be easily peeled off from the first and second bases 122 and 123 when the end 1211 of the leading portion 121 of the cutting tape 120 attached to the bag body 110 and the base film 111 overlaid on the leading portion 121 are held and pulled. In short, the bag can be opened without tearing resistance.

Moreover, since the base film 111 is torn away while guided by the leading portion 121, the bag body 110 can linearly be torn away along the leading portion 121.

(2) When opening the bag, the opening 114 is provided between the first base 122 and the second base 123 which are laminated on the leading portion 121. The opening 114 is covered with the leading portion 121 before the bag is opened. When the bag is opened, the leading portion 121 is peeled off from the first base 122 and the second base 123, thereby opening the opening 114. With this arrangement, the opening 114 is surrounded by the first base 122 and the second base 123. Accordingly, when being opened, the opening 114 can be easily and widely opened since fingers easily pinch the surrounding first and second bases 122 and 123.

(3) In this exemplary embodiment, each of the protrusions 1223 and 1233 is adjusted to have a thickness such that the base welded surfaces 1223A and 1233A of the protrusions 1223 and 1233 are in plane with the surface 124A of the seal layer 124 to be welded on the sealant layer 1111. With this arrangement, when the cutting tape 120 is attached to the bag body 110, sealing of the leading portion 121 and the sealant layer 1111, sealing of the leading portion 121 and the laminated portions 1221 and 1231, and sealing of the protrusions 1223 and 1233 and the sealant layer 1111 can be simultaneously carried out in a single sealing step and in more accurate and clear manner.

(4) The distance between leading portion 121 and the protrusions 1223 and 1233 is defined from 0.1 mm to less than the width of the leading portion 121. Accordingly, when the cutting tape 120 is sealed on the sealant layer 1111, the leading portion 121 is not integrated with the protrusions 1223 and 1233, thereby achieving easy-open performance.

Particularly, since the protrusions 1223 and 1233 are formed in a substantially trapezoidal cross section, the distance A' can be secured even when the sealing positions are displaced. Consequently, a packaging bag provided with a cutting tape having easy-open performance can be reliably manufactured and defective products can be reduced.

(5) The seal layer 124 is laminated on the leading portion 121 and welded on the sealant layer 1111. The resin of the seal layer 124 is highly compatible with resins of the leading portion 121 and the sealant layer 1111, so that bonding strength between the leading portion 121, the seal layer 124 and the sealant layer 1111 is strong. In other words, the leading portion 121 and the sealant layer 1111 are never erroneously peeled off from each other when the bag is opened. Hence, easy-open performance can be improved and an opened packaging bag can be kept in a good condition.

(6) In this exemplary embodiment, with such a quite simple arrangement including the cutting tape 120 provided with the leading portion 121 and the first and second bases 122 and 123, the cutting tape can be easily produced in a single step by co-extrusion and the like. With the use of such co-extrusion for producing the cutting tape 120, the manufacturing step can be simplified, the production cost can be reduced and the cutting tape 120 can be stably and continuously produced.

The invention is not limited to the above-described present embodiments, but includes modifications and improvements as long as an object of the present invention can be achieved.

Figure 6A:
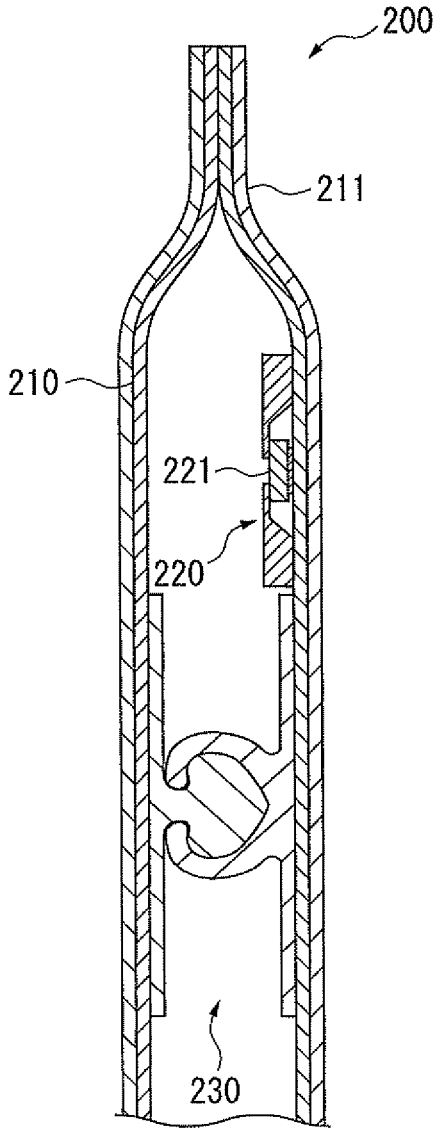
FIG. 6A shows a cross section of a packaging bag provided with a cutting tape according to a modification of the invention.

In the above exemplary embodiment, for instance, only the cutting tape 120 is attached to the inner surface of the bag body 110. However, as shown in FIG. 6A, a packaging bag 200 may be provided with a fastener tape 230 on an inner surface of a bag body 210 adjacent to a content relative to a cutting tape 220.

Figure 6B:
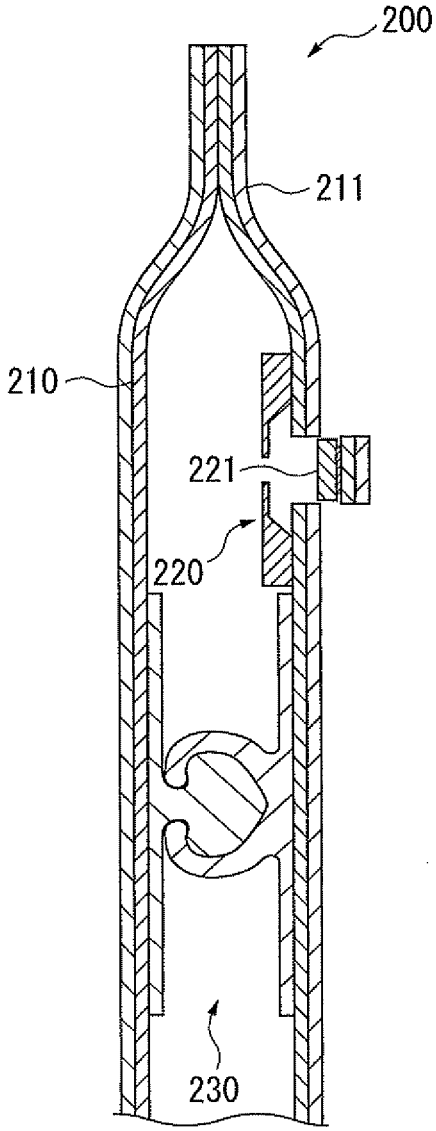
FIG. 6B shows a cross section of the packaging bag of FIG. 6A which the cutting bag has been torn away.
Figure 6C:
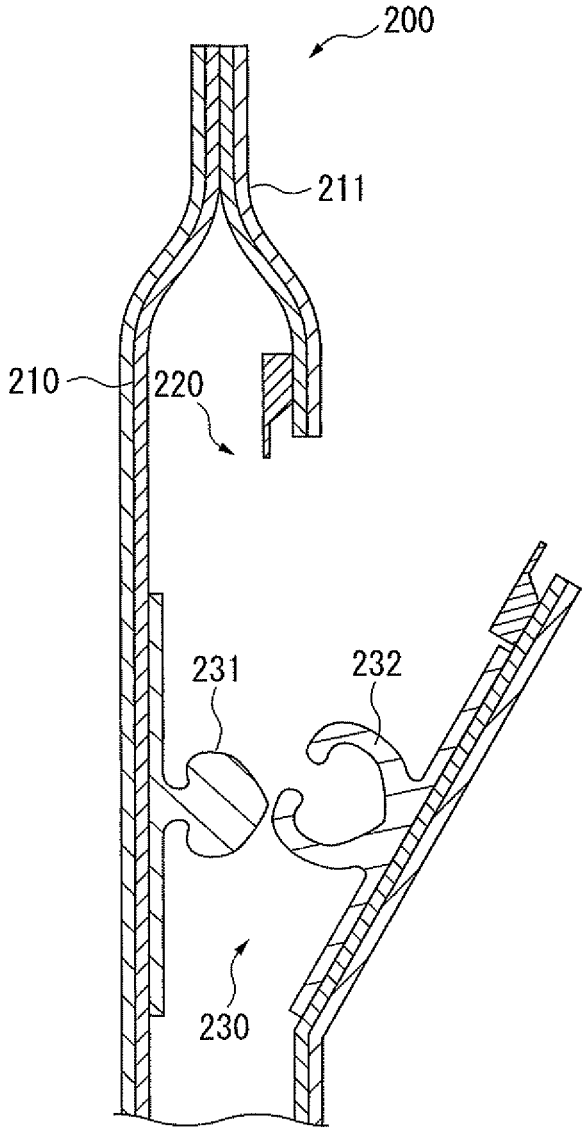
FIG. 6C shows a cross section of the packaging bag provided with the cutting tape of FIG. 6A which is to be opened.

With this arrangement, a leading portion 221 of the cutting tape 220 and a base film 211 welded on the leading portion 221 are pinched at the same time and torn away in a direction away from the bag body 210 to open the bag (see FIG. 6B). After opening the bag, a male member 231 and a female member 232 of the fastener tape 230 are disengaged to further open the bag (see FIG. 6C). When the bag is re-closed, the male member 231 and the female member 232 are re-engaged.

EXAMPLE

Now, the present invention will more specifically be described below by providing examples and comparisons, the content of which by no means limits the scope of the present invention.

Example 1

A cutting tape was obtained by a co-extrusion using a low-density polyethylene (density 926 kg/m$^3$, MFR 1.5 g/10 min) for a base resin, random polypropylene (density 900 kg/m$^3$, MFR 7.0 g/10 min) for a tearing guide piece, and linear low-density polyethylene (density 900 kg/m$^3$, MFR 4 g/10 min) for a seal layer laminated on the tearing guide piece. A size of the cutting tape was A=1 mm, B=3.5 mm (a thickness of 350 μm), and C=1.5 mm (a thickness of 600 μm) in FIG. 3.

A film in which the cutting tape, a 15-μm thick biaxially oriented nylon film and a 50-μm thick linear low-density polyethylene film were dry-laminated was formed to a bag using a fastener-tape-attaching three-side bag-making machine to provide a packaging bag provided with a fastener tape. After heat-sealing the periphery of the bag provided with the fastener tape, notches are provided on both sides of the cutting tape.

Example 2

A cutting tape was obtained in the same manner as in Example 1 except for a different size of the cutting tape.

A size of the cutting tape was A=3.5 mm, B=3.5 mm (a thickness of 350 μm), and C=1.5 mm (a thickness of 600 μm) in FIG. 3.

A packaging bag provided with a fastener tape was obtained in the same manner as in Example 1.

Comparative 1

As disclosed in JP-A-10-59384, a reinforcement string, mono-filament made from stretched polyethylene, and polyethylene for a guiding tape were used to obtain a bag of Example 1 of JP-A-10-59384.

[Evaluation]

Packaging bags obtained by Examples 1 to 2 and Comparative 1 were opened and evaluated in terms of tearing resistance and tearing performance. The evaluation contents are as follows.

Tearing Resistance

A: no resistance/easily cut

B: felt resistance, but cuttable

C: resistance/non-cuttable

Tearing Performance

A: linearly tearable/easily openable

B: linearly tearable, but wavy cutting edges

C: not linearly tearable/difficulty in opening

TABLE 1

| | Tearing Resistance | Tearing Performance |
|---|---|---|
| Example 1 | A | A |
| Example 2 | B | B |
| Comparative 1 | C | C |

As understood from Table 1, Example 1 showed easy open performance without tearing resistance and linear open performance. Example 2 indicated no practical problem.

On the other hand, in Comparative 1, the packaging bag could not be cut even by pulling the guiding tape. When the packaging bag was managed to be cut, the packaging bag could not linearly be torn away.

The invention claimed is:

1. A cutting tape provided on an inner surface of a bag body of a packaging bag, comprising:

a leading portion wherein a surface of the leading portion is attached to the inner surface of the bag body; and a base, wherein the base is comprised of a body portion and a thin laminated portion wherein the thin laminated portion of the base is laminated on a surface of the leading portion opposite to the surface of the leading portion that is attached to the inner surface of the bag body and wherein the body portion of the base is attached to the inner surface of the bag body, wherein a portion of the leading portion that is opposite to the surface of the leading portion that is attached to the inner surface of the bag body is exposed, wherein the leading portion and the base are formed of mutually non-compatible resins;

wherein the base includes a first and a second base with the leading portion interposed therebetween, wherein each of the first base and the second base includes the laminated portion and the body portion;

the laminated portion of the first base and the laminated portion of the second base are opposed to each other; and the exposed portion is formed between the laminated portion of the first base and the laminated portion of the second base.

2. The cutting tape according to claim 1, wherein the body portion includes a protrusion having a substantially rectangular cross section that projects toward the inner surface of the bag body.

3. The cutting tape according to claim 2, wherein a distance between the leading portion and the protrusion is from 0.1 mm to less than the width of the leading portion.

4. The cutting tape according to claim 1, wherein a width of the exposed portion in a direction perpendicular to a longitudinal direction of the leading portion is from 0.1 mm to less than a width of the leading portion.

5. The cutting tape according to claim 1, wherein a seal layer is laminated on a surface of the leading portion adjacent to the inner surface of the bag body.

6. A packaging bag, provided with the cutting tape according to claim 1.

7. The packaging bag according to claim 6, wherein a fastener tape is attached to the inner surface of the bag body adjacent to a content relative to the cutting tape.

* * * * *